United States Patent [19]

Miller

[11] 4,198,997

[45] Apr. 22, 1980

[54] TENSION RIDGE TENT

[76] Inventor: Jack V. Miller, 700 N. Auburn Ave., Sierra Madre, Calif. 91024

[21] Appl. No.: 9,826

[22] Filed: Feb. 5, 1979

[51] Int. Cl.[2] ..... A45F 1/00; A45F 1/06; A45F 1/08

[52] U.S. Cl. ..... 135/1 R; 135/8; 135/14 D

[58] Field of Search ..... 135/1 R, 8, 14 D

[56] References Cited

U.S. PATENT DOCUMENTS

| | | | |
|---|---|---|---|
| 872,122 | 11/1907 | Guild | 135/1 R |
| 1,057,628 | 4/1913 | Eberhardt | 135/1 R |
| 1,239,550 | 9/1917 | Wykert | 135/1 R |
| 1,658,214 | 2/1928 | Thomas | 135/1 R |
| 2,263,867 | 11/1941 | Barnard | 135/1 R |
| 2,442,132 | 5/1948 | Laythe | 135/1 R |
| 2,567,697 | 9/1951 | Craighead et al. | 135/1 R |

*Primary Examiner*—J. Karl Bell

[57] ABSTRACT

A tent comprises a trapezoidal floor, two congruent trapezoidal side walls contiguous at the ridge line, a front wall in the shape of an equilateral triangle and including a door opening, and a rear wall in the shape of an obtuse isosceles triangle; wherein the triangular perimeter at every transverse cross-section is constant. The tent is supported principally by a tension line through the ridge line of the tent which is secured to a point outside the front of the tent and higher than the peak of the front, and is also secured to a second point outside the rear of the tent at the ground, with the floor and side walls of the tent being held in membrane tension by ground stakes at the lower apex points of the front and rear walls. The front door panel is held closed by an elastic member stretched in a straight line across the threshold and attached along its length to the shirred lower edge of the door panel.

4 Claims, 6 Drawing Figures

TENSION RIDGE TENT

BACKGROUND OF THE INVENTION

This invention relates to tents, and more particularly to those tents which may be supported by securing one or more lines to a nearby attachment point external to the tent. Such tents are in common use in the form of "tube tents" which are simply open-ended plastic tubes. This type of tent is supported by a line passed through it length and tied at ridge height between two trees, and the absence of any poles or frame makes it very inexpensive. There is no provision for closing the ends, so protection from weather is minimal. The present invention provides a more complete tent which requires no structural frame or poles other than a single tree to establish height and ground stakes to provide the tent shape, thereby removing the necessity of finding two appropriately spaced trees for support. The tent of the invention may be readily fabricated from a variety of woven or non-woven material, and is erected with minimal skill required.

The invention provides an extremely light and simple tent having a floor and two side walls joined into a triangular tube. The front wall, which comprises the door, is in the shape of an equilateral triangle of appropriate height for the type of use intended, and the rear wall is in the shape of an obtuse isosceles triangle of lesser height than the front wall. The cross-sectional shape of the tent is then triangular at every point along its length, and the perimeter of the cross-section is constant for every point. This makes it possible to join the selvage edges of three identical lengths of fabric without cutting or waste. Since the ridge line is lower at the rear the constant perimeter dictates that the floor is wider at the rear; making the floor trapezoidal with parallel front and rear edges, while the side walls also become trapezoidal with parallel front and rear edges.

The tent of the invention is supported primarily by a tension line tied to a single tree or post outside the front of the tent and higher than the front peak of the ridge, with the tension line passing through the length of the tent and comprising the ridge to exit the tent and the peak of the rear wall and being secured to a stake a distance outside the rear of the tent. The floor and walls are then stretched to shape by ground stakes at the four corners of the tent floor. The tent therefore requires no poles or framework of any kind, resulting in an extremely lightweight and inexpensive shelter. In group camping, such as scouting activities, a group of three or more tents of the present invention may all be attached to a single common tree, post or guidon staff with the plurality of ridge lines pulled radially outwards to stakes whereby the lines support the staff and form the tent ridges as well.

The openable door of the tent simply comprises a panel of fabric attached to the front edges of the side walls and shirred or gathered with elastic across the bottom or threshold, so the bottom of the door is lifted for entry and snaps back down for closure.

DESCRIPTION OF THE PREFERRED EMBODIMENTS

Figure 1:
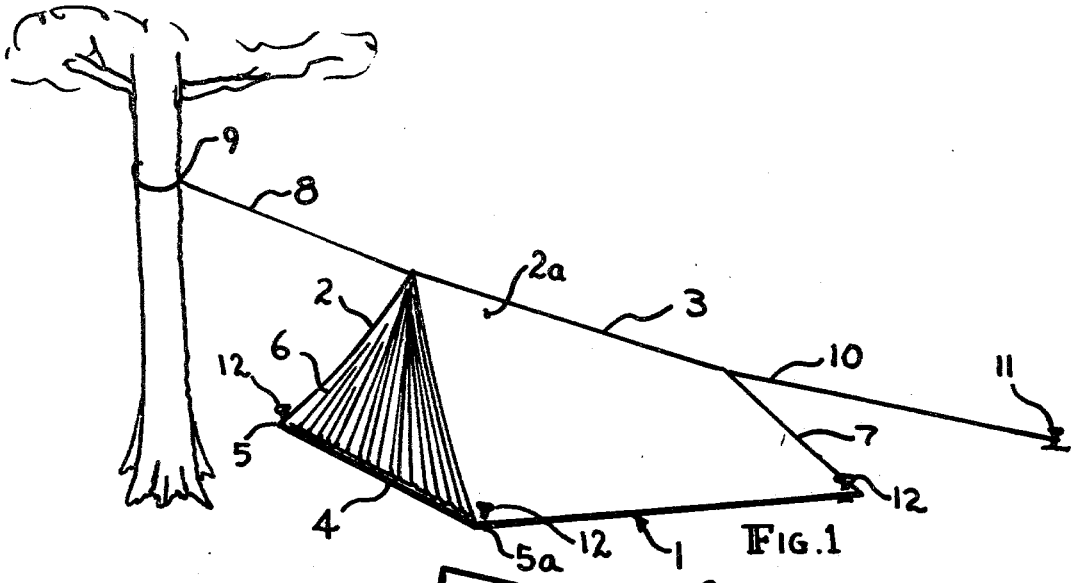
FIG. 1 is a perspective view of the tent according to the invention.

In FIG. 1 a tent 1 is shown having generally trapezoidal sides 2 and 2*a* joined at a ridge 3, and also joined to a floor 4 a ground apex lines 5 and 5*a* respectively, thereby forming a generally triangular tube closed at the front by a triangular door 6 and also closed at the rear be a rear wall 7. Ridge 3 is supported by a front tension line 8 which is secured to a point outside the tent and higher than the front peak, illustrated as point 9. Ridge 3 is further supported by a rear tension line 10 which is secured to a ground point 11, which may be a ground stake. The perimeter of the tent is established by a plurality of stakes 12.

Figure 2:
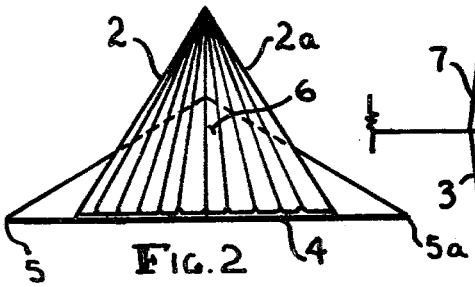
FIG. 2 is a front elevation view of the tent of FIG. 1.

In FIG. 2 the front wall 6 comprising the entrance door is shown in the general shape of an equilateral triangle bounded by the front edges of side 2 and 2*a* respectively and the front edge of floor 4.

Figure 3:
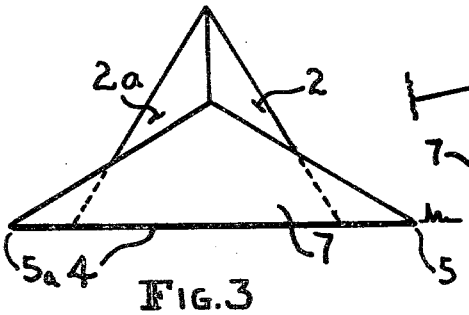
FIG. 3 is a rear elevation view of the tent of FIG. 1.

FIG. 3 shows the rear wall 7 generally in the shape of an obtuse isosceles triangle bounded by the rear edges of sides 2 and 2*a* respectively and the rear edge of floor 4.

Figure 4:
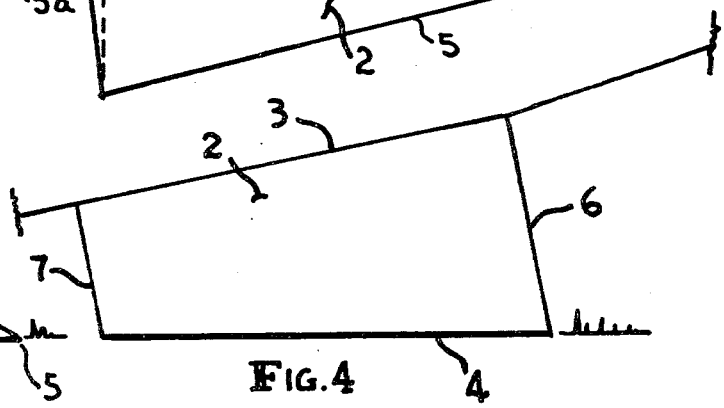
FIG. 4 is a side elevation view of the tent of FIG. 1.

FIG. 4 illustrates a side elevation view in which side 2 is shown as bounded by the ridge line 3 at the top, door 6 at the front, rear wall 7 at the back and floor 4 at the ground plane.

Figure 5:
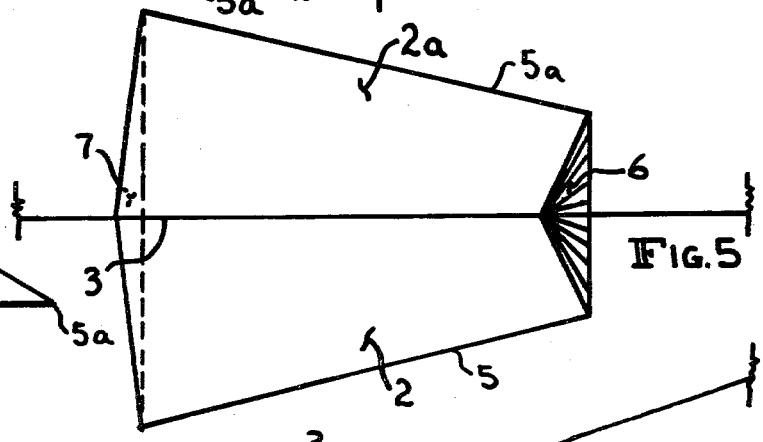
FIG. 5 is a plan view of the tent of FIG. 1.

FIG. 5 shows the plan view of the floor 4 generally in the shape of a trapezoid; bounded by the lower edge of door 6 at the front, by the lower edge of rear wall 7 at the back and at either side by the lower edges of sides 2 and 2*a*, respectively.

Figure 6:
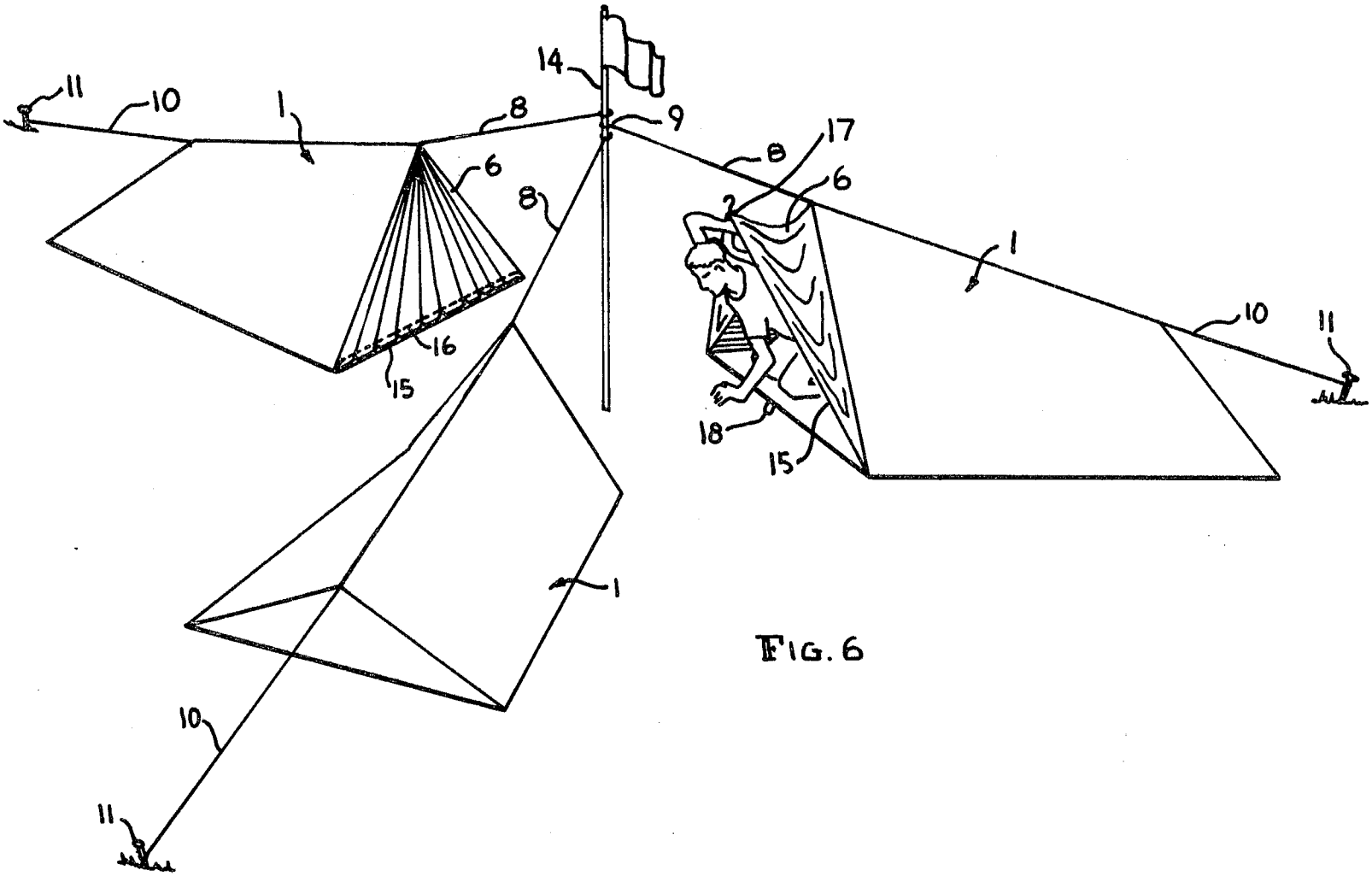
FIG. 6 is a perspective view illustrating the use of a plurality of tents according to the invention.

FIG. 6 shows a plurality of tents 1 having their front tension lines 8 secured to a common tie point 9 on an otherwise unsupported pole or staff 14. Each tent has its rear tension line 10 secured to a stake 11 on an angularly spaced radial line from point 9 so that the tents stabilize staff 14 and staff 14 provides the height for the tension lines for all the tents. Each tent has its door panel 6 contiguous with the front edges of sides 2 and 2*a*, respectively, and each door further has a bottom edge 15 abutting but not joined to the front edge of the floor 4. The bottom edge 15 of door panel 6 is shirred or gathered on an elastic band 16 which is stretched between ground apex points 5 and 5*a*, respectively, so as to resiliently hold the door closed. In order to enter or leave the tent a camper need only lift the lower door edge 15 to pass through and let it snap down again to the closed position. A hook means 17 is provided at the center of the lower door edge 15, which is engageable with an eye means 18 at the adjacent floor point to secure the door closed. In order to secure the door open hook 17 is engaged over the front tension line 8.

Referring again to FIGS. 2 and 3, the triangular perimeter of the equilateral triangle shown as the front of the tent in FIG. 2 is identical to the perimeter of the obtuse isosceles triangle shown as the back of the tent in FIG. 3. The cross-sectional perimeter then at any position along the tent length is also constant. This permits the joining of three equal width fabric lengths to form the side walls and floor of the tent without cutting or scrap.

I claim:

1. A tent having a generally trapezoidal floor, two congruent trapezoidal side walls contiguous at a ridge line, a front wall generally in the shape of an equilateral triangle, and a rear wall generally in the shape of an obtuse isosceles triangle; wherein the triangular perimeter at every transverse cross-section is a constant.

2. A tent according to claim 1 in which the front wall comprises a door opening having a flexible closure panel contiguous with the two side walls; having a bottom width approximately equal to the sum of the two sides, said bottom width being shirred and held resiliently in a straight line across the floor threshold by an elastic tension member stretched between the floor apex points of the triangular front wall.

3. A tent according to claim 1 in which the ridge line is supported by a tension line secured to a point external to the front of the tent and higher than the peak of front wall, and further secured to a second point external to the rear of the tent at ground level; and the walls and floor panels are retained in membrane tension by ground stakes placed at least at the ground apex points of the front and rear walls.

4. A tent according to claim 2 in which a hook means is located approximately at the center of bottom of the door closure panel, and an eye means is located at the center of the floor threshold; whereby the hook may be engaged with said eye to hold the door closed, or the hook may engage the ridge line to hold the door open.

* * * * *